United States Patent [19]

Taketomi

[11] 4,070,976

[45] Jan. 31, 1978

[54] UPPER THREAD TAKE-UP LEVERS FOR SEWING MACHINES

[76] Inventor: Bunsaku Taketomi, 56-141 Ishikane, Iwasaki, Nisshin-cho, Aichi, Aichi, Japan

[21] Appl. No.: 764,538

[22] Filed: Feb. 1, 1977

[51] Int. Cl.[2] ..... D05B 49/00

[52] U.S. Cl. ..... 112/241

[58] Field of Search ..... 112/241, 248, 247, 181, 112/242, 185, 57, 96

[56] References Cited

U.S. PATENT DOCUMENTS

| | | | |
|---|---|---|---|
| 2,332,920 | 10/1943 | Kucera | 112/242 |
| 2,550,628 | 4/1951 | Webster | 112/241 |
| 2,997,010 | 8/1961 | Hughes | 112/241 X |
| 3,307,509 | 3/1967 | Ioannilli et al. | 112/57 |

FOREIGN PATENT DOCUMENTS

| | | | |
|---|---|---|---|
| 45,813 | 1/1889 | Germany | 112/241 |
| 3,651 of | 1894 | United Kingdom | 112/57 |

*Primary Examiner*—Werner H. Schroeder
*Assistant Examiner*—Moshe I. Cohen
*Attorney, Agent, or Firm*—Dennison, Dennison, Meserole & Pollack

[57] ABSTRACT

Disclosed is an improved upper thread take-up lever for a two-thread sewing machine. The improvement comprises at least one vertically disposed pulley rotatably supported adjacent to the free end of the lever and a member secured to the free end of the lever for supporting the pulley rotatably in unison with another vertically disposed pulley in the vicinity of a tension disc.

16 Claims, 11 Drawing Figures

Fig. 8
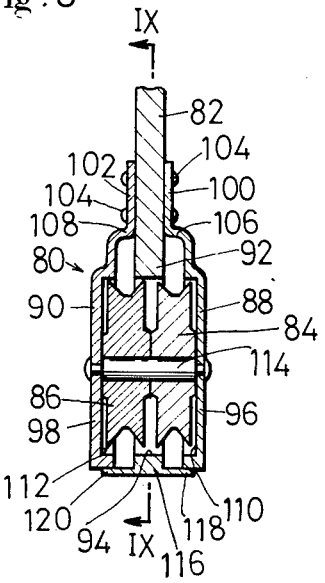
Fig. 9
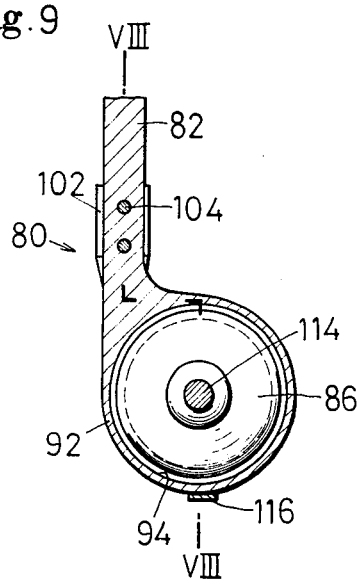
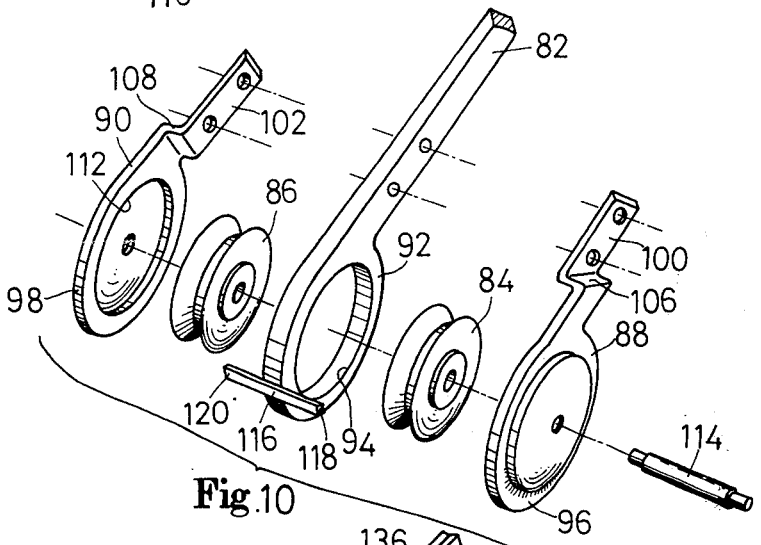
Fig. 10
Fig. 11
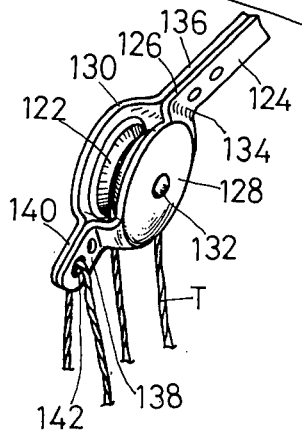

UPPER THREAD TAKE-UP LEVERS FOR SEWING MACHINES

This invention relates to an improved upper thread take-up lever or upper thread guiding device for a two-thread sewing machine.

An ordinary sewing machine has a thread take-up lever provided at its free end with an aperture through which to pass an upper thread extending upwardly from a tension disc. There is also known an upper thread take-up lever having at its free end a pair of apertures which cooperates with a pulley rotatably supported in the vicinity of a tension disc to provide a double fold of an upper thread between the tension disc and a sewing needle. This double folding advantageously provides an approximately twice greater upper thread length between the tension disc and the needle and, thus, permits use of a considerably greater length of an under thread for the stitching operation. This known arrangement is, however, still unsatisfactory because of the development of unduly great frictional resistance by the peripheral edges of the lever apertures against the upper thread whenever the thread is tightened during the stitching operation. Such frictional resistance is present, however carefully the peripheral edges of the lever apertures may be finished. Thus, the upper thread is often subjected to excessive tension with a resultant breakage.

In view of the aforementioned drawbacks of the prior art, it is an object of this invention to provide an improved upper thread take-up construction for a sewing machine which can feed a substantially great upper thread length between an upper thread spool and a sewing needle, permitting use of a very large under thread bobbin, without imposing any appreciable resistance to the movement of the upper thread, while maintaining the upper thread under proper tension whenever necessary.

It is another object of this invention to provide an improved upper thread take-up lever for a sewing machine which is easy to use or supply with an upper thread withdrawn from a spool to be passed through a needle aperture.

The take-up lever construction of this invention is essentially characterized by including at least one pulley vertically disposed and rotatably supported on the free end of an otherwise ordinary upper thread take-up lever in a sewing machine. This pulley device cooperates with another pulley vertically disposed therebelow in the vicinity of a tension disc to retain an upper thread in a double folded pattern, so that a supply of a substantially long upper thread section can be maintained between the tension disc and a sewing needle. The invention may, in the first place, comprise a pair of coaxially disposed pulleys each having a single guide groove therearound. Alternatively, the device of this invention may comprise a single pulley having a pair of parallel grooves formed therearound. As a further alternative, the device of this invention may comprise a single pulley having a single groove and rotatably supported at the free end of the take-up lever, and means for supporting the pulley relative to the free end of the take-up lever, which means is provided with an aperture through which the upper thread may be passed after it is passed around the pulley adjacent to the free end of the lever and the pulley in the vicinity of the tension disc.

According to another aspect of this invention, means secured to the free end of the take-up lever for supporting the pulleys rotatably preserves a sufficiently large clearance through which to locate an upper thread around the pulleys, while preventing the thread from slipping out of the device.

According to this invention, storage of an upper thread in a doubly folded pattern in an area between the tension disc and the needle permits the take-up lever to handle during its vertical reciprocatory movement an upper thread length which is approximately four times as long as the stroke of vertical movement of an ordinary take-up lever. This permits use of a very large bobbin carrying an under thread having a very large overall length which is approximately ten or even more times as large as the length of an under thread wound on an ordinary bobbin.

The most significant feature of this invention lies in the use of a pulley or pulleys for guiding an upper thread. The pulleys are appropriately supported for free rotatation with the movement of the upper thread during very frequent reciprocatory motion of the take-up lever. Such rotation of the pulleys ensures that the thread is not subjected to any undesirable frictional resistance that may result in thread breakage as hitherto encountered, whenever it is tightened, so that the upper thread can be maintained sufficiently tight whenever required during the stitching operation.

Other features and advantages of this invention will become apparent from the following detailed description and the accompanying drawings, in which:

FIG. 8 is a top plan sectional view showing another embodiment of this invention;

FIg. 9 is a sectional view taken along line IX—IX of FIG. 8;

FIG. 10 is an exploded, perspective view of the device shown in FIG. 8; and fIG. 11 is a perspective view of a further modification of this invention.

The invention will now be described in further detail by way of example with reference to the accompanying drawings in which like reference numerals are used to indicate like parts or elements.

Figure 1:
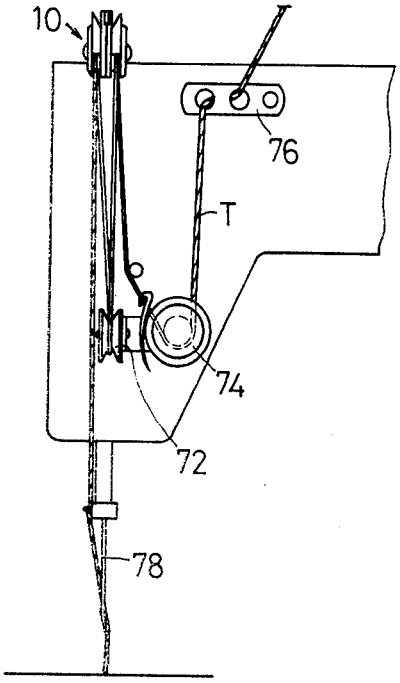
FIG. 1 is a fragmentary front elevational view of a sewing machine equipped with an improved upper thread take-up lever embodying this invention.
Figure 2:
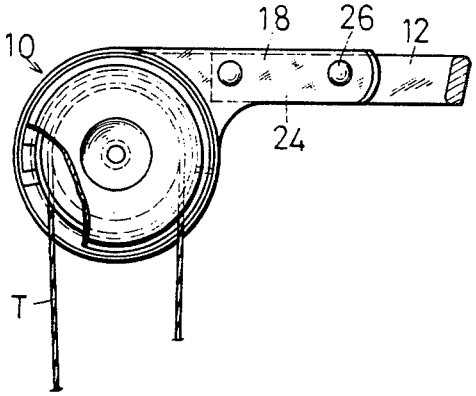
FIG. 2 is an enlarged side elevational view, partly in section, of the device of this invention shown in FIG. 1.
Figure 3:
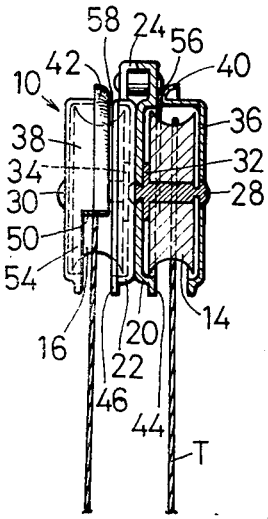
FIG. 3 is a front elevational view, partly in section, of the device shown in FIG. 2.

Referring now to the drawings in further detail, particularly FIGS. 1 through 7 thereof, there is shown a pulley device for an upper thread embodying this invention as generally indicated at 10 and secured to the free end of an ordinary upper thread take-up lever 12 on a sewing machine. The pulley device 10 comprises a pair of pulleys 14 and 16 disposed vertically in mutually contiguously spaced, coaxial relationship and a member 18 interposed between the pulleys 14 and 16 for supporting them rotatably on the take-up lever 12. The supporting member 18 includes a pair of circular, outwardly concave pulley receptacles 20 and 22 resting back to back on each other. An integral mounting arm 24 having a downwardly open channel-shaped cross section extends tangentially from the receptacles 20 and 22, and is inserted over and connected to the free end of the take-up lever 12 by rivets 26 as shown in FIG. 2. A pair of pins 28 and 30 extend in opposite directions from the receptacles 20 and 22, respectively, in coaxial relationship thereto. One pin 28 is secured to the center of one receptacle 20 at one end and supports the pulley 14 rotatably thereon. The pin 28 is formed at its one end with a circular flange 32 secured to the bottom surface of the receptacle 20 and spacing the pulley 14 therefrom. Likewise, the other pin 30 is secured to the other receptacle 22 to rotatably support the other pulley 16 and has a circular flange 34 spacing the pulley 16 from the receptacle 22 as shown in FIG. 3. A circular dish-shaped cover 36 is secured at its center to the other end of the pin 28 and encloses the pulley 14. The other end of the pin 28 is flattened out to fasten the cover 36 firmly. Another circular dish-shaped cover 38 is likewise secured to the pin 30 to enclose the pulley 16.

Figure 4:
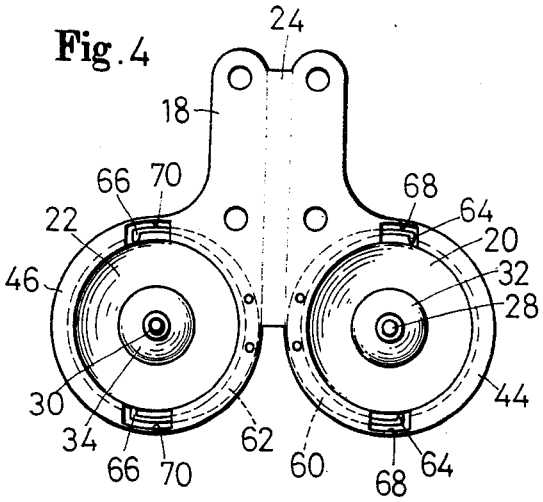
FIG. 4 is an exploded view of the device shown in FIG. 3.

The cover 36 is provided with a substantially semiannular, outwardly curved flange 40 encircling the upper half of the inner edge of the cover 36. Likewise, the other cover 38 is formed with a similar flange 42 as shown in FIG. 3. The receptacle 20 is provided with a radially outwardly projecting circular flange 44 and the other receptacle 22 has a similar flange 46. The mounting arm 24 extends from the flanges 44 and 46 integrally therewith as best shown in FIG. 4 and terminates at the top of the receptacles 20 and 22. The cover 36 is formed on its inner edge with a downwardly facing shoulder 48 which is flush with the lower end of the flange 40 and which defines a shallower lower half portion 52 of the cover 36 at which the cover 36 is spaced more widely from the receptacle 20 than at its upper half portion. Likewise, the other cover 38 is provided with a similar shoulder 50 defining a shallower lower half portion 54 of the cover 38. The cover 36 is positioned so close to the receptacle 20 that only a very narrow semi-circular clearance 56 is present between the flange 40 of the cover 36 and the flange 44 of the receptacle 20 as shown in FIG. 3. The clearance 56 is very narrow and is preferably about 0.3 mm in width for the purpose which will hereinafter become apparent. Likewise, the other cover 38 is positioned so close to the receptacle 22 as to define a very narrow clearance 58 of about 0.3 mm in width between the flanges 42 and 46.

Figure 5:
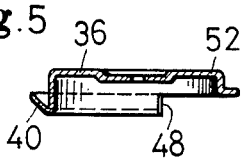
FIG. 5 is a front elevational view, partly in section, of the device shown in FIG. 4.
Figure 6:
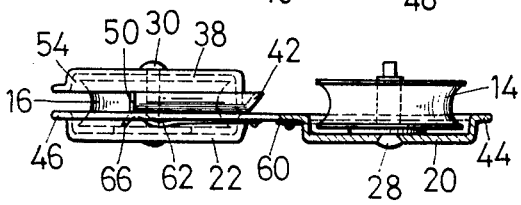
FIG. 6 is a front elevational view in section of a pulley cover.
Figure 7:
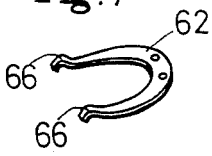
FIG. 7 is a perspective view of a spring.

The receptacle 20 is provided with a substantially semi-annular leaf spring 60 which has an arcuately shaped middle portion appropriately pinned to the rear face of the flange 44 and which extends substantially along the upper half of the flange 44 as is obvious from FIG. 4. The spring 60 terminates in a pair of semi-circularly bent ends 64 projecting toward the cover 36 as is obvious from FIG. 5. Likewise, the other receptacle 22 is provided with a similar spring 62 extending substantially along the upper half of the flange 46 and having a pair of semi-circular ends 66 as shown in FIG. 7 and projecting toward the cover 38 as shown in FIG. 5. The flange 44 of the receptacle 20 is formed with a pair of generally diametrically opposite slits 68 as shown in FIG. 4. The slits 68 are positioned in close proximity to the lower ends of the flange 40 of the cover 36 and the semi-circular ends 64 of the spring 60. The semi-circular ends 64 of the spring 60 project through the slits 68 and are resiliently supported on the opposite lower ends of the flange 40 for the purpose which will hereinafter become apparent. Likewise, the flange 46 of the other receptacle 22 are provided with a pair of similar slits 70 which are positioned in close proximity to the lower ends of the flange 42 of the cover 38 and through which the semi-circular ends 66 of the spring 62 extend are are resiliently supported on the opposite ends of the flange 42 as is obvious from FIG. 4.

Thus, the receptacle 20 and its cover 36 form a first housing in which the first pulley 14 is rotatably supported, while the receptacle 22 and its cover 38 form a second housing in which the second pulley 16 is rotatably supported.

A third pulley 72 is rotatably supported on the frame of the sewing machine in the vicinity of a tension disc 74. The pulley 72 is vertically disposed in a vertical plane which substantially coincides with the vertical plane in which the first pulley 14 is positioned, as shown in FIG. 1.

The pulley supporting member 18 and the covers 36 and 38 may easily be fabricated by press forming. The flanges 40 and 42 on the covers 36 and 38, respectively, are each arcuately curved outwardly, as shown in FIG. 3, to provide a smooth thread guiding surface extending to the clearance 56 or 58.

Referring to FIG. 1, an upper thread T withdrawn from a spool not shown is passed through a hook member 76 and then about the tension disc 74. The thead T is, then, placed into the first housing through the clearance 56 and passed around the first pulley 14. The thread T extending downwardly from the pulley 14 is passed around the third pulley 72 and is brought upward again. The thread T is passed around the second pulley 16 and extends therefrom downwardly to be passed through an aperture on a needle 78. For placement of the thread T around the pulley 16, it is inserted into the second housing through the clearance 58. The curved guide surfaces on the cover flanges 40 and 42 greatly facilitate insertion of the thead T into the first and second housings through the very narrow clearances 56 and 58. When the thread T is placed into the first and second housings, the springs 60 and 62 are easily pushed away from the lower ends of the flanges 40 and 42 by the thread T to open a way for the thread T into the respective housings to be properly passed around the pulleys 14 and 16. The springs 60 and 62 are resiliently supported on the lower ends of the flanges 40 and 42, respectively, with a light force which permits the springs 60 and 62 to be easily pushed back by the thread T itself without causing the breakage of the thread T. The springs 60 and 62 are, however, resilient enough to return into abutment on the lower ends of the flanges 40 and 42 upon slipping of the tread T into the peripheral grooves of the pulleys 14 and 16. Thus, the springs 60 and 62 serve as means for closing the inlet for the thread T and preventing it from slipping out of the first and second housings to maintain it correctly in position relative to the pulleys 14 and 16 even during rapid movement of the take-up lever 12.

Attention is now directed to FIGS. 8 through 10 of the drawings, in which a modified form of the pulley device according to this invention is generally indicated at 80. The pulley device 80 comprises a pulley housing secured to the free end of an upper thread take-up lever 82 on a two-thread sewing machine. A pair of pulleys 84 and 86 are rotatably supported in the pulley housing in coaxial relationship with each other. The pulley housing is formed by a pair of pulley supporting members 88 and 90 secured to the free end of the upper thread take-up lever 82. The free end of the take-up lever 82 is formed with a ring 92 encircling the pulleys 84 and 86 in coaxial relationship therewith and having a hole 94 within which the pulleys 84 and 86 are partly positioned. The hole 94 is somewhat greater in diameter than the pulleys 84 and 86. The take-up lever 82 extends from the ring 92 in tangential relationship thereto. The pulley supporting members 88 and 90 each has a circular receptacle portion and a mounting arm formed integrally with the receptacle portion and extending therefrom in tangential relationship thereto. The pulley supporting members 88 and 90 are located on the opposite sides of the ring 92 from each other and the receptacle portions 96 and 98 of the members 88 and 90 are coaxial with the ring 92. The mounting arms 100 and 102 of the pulley supporting members 88 and 90, respectively, extend along the free end of the take-up lever 82 and are secured thereto by rivets 104. The mounting arms 100 and 102 are outwardly shouldered at 106 and 108, respectively, so that the receptacle portions 96 and 98 are spaced apart from the ring 92 as shown in FIG. 8. The receptacle portion 96 is formed with a circular recess 110 facing the hole 94 of the ring 92 in coaxial relationship therewith. The recess 110 is somewhat greater in diameter than the pulley 84 and partly encircles the pulley 84. Likewise, the receptacle portion 98 has a circular recess 112 facing the ring 92 and partly encircling the pulley 86. A pin 114 having a circular cross-section has a pair of ends flattened out and secured to the receptacle portions 96 and 98, respectively, at the center of the circular receses 110 and 112. The pin 114 extends through the pulleys 84 and 86 to support them freely rotatably thereon. A horizontally disposed, elongate holding member 116 is carried on the outer edge of the ring 92 in a position remote from the take-up lever 82. The holding member 116 comprises a small bar having a rectangular cross-section and integrally secured to the ring 92 in the middle portion of its length. The holding member 116 extends in perpendicular relationship to the take-up lever 82 and has a pair of ends 118 and 120 secured to the receptacle portions 96 and 98, respectively. The holding member 116, thus, spans the circular clearances between the ring 92 and the receptacle portions 96 and 98 and prevents any slipping of an upper thread (not shown) out of the pulley housing in cooperative relationship with the mounting arms 100 and 102 which closes the circular clearances between the ring 92 and the receptacle portions 96 and 98 in a position approximately diametrically opposite to the holding member 116. The other elements and features of the device described above with reference to FIGS. 8 through 10, as well as its associated parts on the sewing machine frame, are analogous to those referred to in the description of the device shown in FIGS. 1 through 7.

As can be seen in FIG. 8, the pulley 84 is positioned outside of the recess 110 of the receptacle portion 96 in the greater part of its thickness. Likewise, the other pulley 86 is exposed outside of the recess 112 of the other receptacle portion 98 in the greater part of its thickness. These structural features minimize the possibility of an upper thread slipping off either pulley into the clearance defined by the recess 110 or 112 between the pulley and the adjacent receptacle portion. Even if an upper thread should slip off the groove of either pulley, there can in no event result any difficulty in taking out the thread from the recess of the adjacent receptacle portion and relocating it correctly on the pulley.

The apparatus further includes a third pulley, not shown in FIGS. 8 through 10, vertically disposed and rotatably supported on the frame of the sewing machine in the vicinity of a tension disc also not shown. An upper thread, not shown, is withdrawn from a spool on the machine frame and is passed through a hook member and then about the tension disc. The thread is turned upward at the tension disc and passed around the first pulley 84. The relatively large clearance defined between the pulley 84 and the pulley supporting member 88 by the shoulder 106 on the mounting arm 100 facilitates insertion of the thread into the pulley housing to be passed around the pulley 84. The thread extending downwardly from the first pulley 84 is passed around the third pulley and turned upward again thereat. The thread is, then, passed around the second pulley 86 and extends therefrom downwardly to be passed through a needle aperture.

While the apparatus of FIGS. 8 through 10 includes a pair of separate pulleys as noted, it will easily be understood that it may be modified so as to comprise only a single pulley having a pair of parallel grooves therearound.

Attention is now directed to FIG. 11 illustrating a further modification to this invention. The device shown in FIG. 11 includes a single pulley 122 which is vertically disposed and rotatably supported on the free end of an upper thread take-up lever 124. A pulley supporting member 126 is integrally connected to the free end of the take-up lever 124. The pulley supporting member 126 includes a pair of mutually spaced, parallel receptacle portions 128 and 130 of the generally disc-shaped, coaxial construction. The receptacle portions 128 and 130 are spaced apart from each other at a distance which is large enough to accommodate the pulley 122 therebetween for its free rotational movement. A pin 132 having a circular cross-section has one end secured to the center of one receptacle portion 128, while another end of the pin 132 is secured to the center of the other receptacle 130. The pulley 122 is rotatably supported about the pin 132. The pulley supporting member 126 also includes a pair of mutually converging mounting arms 134 and 136 projecting from the receptacle portions 128 and 130, respectively, and integrally connected with the free end of the take-up lever 124. The pulley supporting member 126 further includes a pair of mutually converging lugs 138 and 140 projecting from the receptacle portions 128 and 130, respectively, in a direction generally diametrically opposite to that in which the mounting arms 134 and 136 extend. The lugs 138 and 140 are joined with each other in an appropriate manner and formed with a circular aperture 142 having an axis which is parallel to the axis of the pulley 122.

Other elements and features of the device shown in FIG. 11, though they are not specifically shown, are analogous to their counterparts already described in connection with the structures shown in FIGS. 1 through 7 and 8 through 10. An upper thread T, which is withdrawn from a spool on the frame of a sewing machine and passed through a hook member and about a tension disc, extends upwardly from the tension disc and is passed around the pulley 122. The receptacle portions 128 and 130 forming a housing for the pulley 122 are spaced from each other wide enough to define a sufficiently large clearance between the pulley 122 and the pulley supporting member 126 through which to pass the thread T about the pulley 122. The thread T extends downwardly from the pulley 122 and is passed around a second pulley vertically disposed and rotatably supported on the machine frame in the vicinity of the tension disc. The thread T is, then directed upward again from the second pulley and passed through the aperture 142 of the lugs 138 and 140. The thread T extending downwardly from the aperture 142 is passed through a needle aperture. The peripheral edges of the aperture 142 are appropriately rounded or chamfered on either side of the lugs 138 and 140 to ensure smooth sliding movement of the thread T. It will readily be understood that the structure of FIG. 11 may easily be modified to comprise a single pulley having a pair of parallel grooves, instead of utilizing an aperture as shown at 142.

Although the invention has hereinabove been described with reference to the preferred embodiment thereof as shown by way of example in the accompanying drawings, it is to be understood that further modifications or variations may be easily be made by any person of ordinary skill in the art within the scope of the appended claims without departing from the spirit of this invention.

What I claim is:

1. In an upper thread take-up lever for a two thread sewing machine, said lever having a free end, said machine having a frame carrying a vertically disposed thread guiding pulley rotatably supported thereon in the vicinity of a tension disc, the improvement which comprises:

upper thread guiding means vertically disposed above said pulley and rotatably supported adjacent to said free end of said lever; and means secured to said free end of said lever for supporting said guiding means rotatably in unison with said pulley.

2. The take-up lever as defined in claim 1, wherein said guiding means comprises:

a single vertically disposed pulley; and said supporting means being formed with an aperture for guiding said thread therethrough.

3. The take-up lever as defined in claim 1, wherein said supporting means comprises:

a pair of coaxially spaced, generally flat circular portions between which said single pulley is interposed in coaxial relationship therewith;

a pair of arms each extending integrally from one of said circular portions and connected to said free end of said lever;

a pin having a pair of ends each secured to one of said circular portions in coaxial relationship therwith, said single pulley being rotatably supported on said pin; and a lug projection extending integrally from said circular portions in a direction substantially diametrically opposite to said free end of said lever relatively to said circular portions, said guiding aperture being formed through said lug projection.

4. The take-up lever as defined in claim 1, wherein said guiding means comprises:

a pair of vertically disposed, coaxial pulleys.

5. The take-up lever as defined in claim 4, wherein said supporting means comprises:

a pair of circular portions which are coaxial with said coaxial pulleys;

elongate means connected at one end to said circular portions and at another end to said free end of said lever for mounting said circular portions relative to said lever; and shaft means secured to said circular portions coaxially therewith and supporting said coaxial pulleys rotatably thereon.

6. The take-up lever as defined in claim 5, wherein said circular portions are axially spaced from each other to define therebetween a generally annular clearance through which said thread extends around said coaxial pulleys, wherein said coaxial pulleys are interposed between said circular portions and each partly encircled by one of said circular portions, and wherein said shaft means comprises a single pin on which said coaxial pulleys are both supported.

7. The take-up lever as defined in claim 6, further including a horizontally disposed elongate member spanning said annular clearance between said circular portions in an area remote from said free end of said lever and having a pair of ends each joined to one of said circular portions.

8. The take-up lever as defined in claim 7, further including a vertically disposed ring formed integrally on said free end of said lever in coaxial relationship with said coaxial pulleys, said ring being slightly greater in diameter than said coaxial pulleys and partly encircling said coaxial pulleys, said elongate member being joined to said ring intermediate said ends thereof.

9. The take-up lever as defined in claim 8, wherein said mounting means comprises a pair of generally flat, parallel arms each integral with one of said circular portions.

10. The take-up lever as defined in claim 5, wherein said circular portions are interposed between said coaxial pulleys, and wherein said shaft means comprises a pair of coaxial pins each supporting one of said coaxial pulleys thereon.

11. The take-up lever as defined in claim 10, further including a pair of coaxially spaced circular covers each secured to one of said pins coaxially therewith, said coaxial pulleys being interposed between said covers.

12. The take-up lever as defined in claim 11, wherein each of said covers is formed in its upper portion with a generally semi-annular edge facing one of said circular portions and slightly spaced therefrom to define between said each cover and said one circular portion a small annular clearance through which said thread is passed.

13. The take-up lever as defined in claim 12, further including a pair of generally semi-annular leaf springs each secured to one of said circular portions and extending along said semi-annular edge of one of said covers, said each spring having a pair of free ends resiliently bearing on said semi-annular edge at a pair of substantially diametrically opposite points relative to said one cover to close said annular clearance at said opposite points.

14. The take-up lever as defined in claim 13, wherein said mounting means comprises a single channel-shaped arm integral with said circular portions.

15. The take-up lever as defined in claim 12, wherein said edge is formed with an outwardly curved, generally semi-annular guide surface for said thread.

16. The take-up lever as defined in claim 15, wherein said guide surface terminates in a pair of downwardly facing shoulders axially enlarging said annular clearance and thereby defining in the lower portion of said each cover a generally semi-annular clearance encircling one of said coaxial pulleys and through which said thread extends around said one coaxial pulley.

* * * * *